US007103916B1

(12) United States Patent
Goodew et al.

(10) Patent No.: US 7,103,916 B1
(45) Date of Patent: Sep. 12, 2006

(54) DISPOSABLE ADHESIVE MULTI-USE BIB

(76) Inventors: Deb Goodew, 506 Tenth St. SW., Austin, MN (US) 55912; LuAnn Heald, 4155 N. Haverhill Rd., Apartment #1413, West Palm Beach, FL (US) 33417

( * ) Notice: Subject to any disclaimer, the term of this patent is extended or adjusted under 35 U.S.C. 154(b) by 385 days.

(21) Appl. No.: 10/671,171

(22) Filed: Sep. 25, 2003

Related U.S. Application Data

(60) Provisional application No. 60/414,731, filed on Sep. 30, 2002.

(51) Int. Cl.
*A41B 13/00* (2006.01)

(52) U.S. Cl. ..... 2/49.1

(58) Field of Classification Search ..... 2/49.1, 2/49.2, 49.3, 49.4, 49.5, 50, 51, 52, 48, 247, 2/46

See application file for complete search history.

(56) References Cited

U.S. PATENT DOCUMENTS

| | | | | |
|---|---|---|---|---|
| 2,900,640 | A | 8/1959 | Haydu | |
| 3,329,969 | A | 7/1967 | Farber et al. | |
| 3,488,773 | A | 1/1970 | Stemmer | 2/49 |
| 3,979,776 | A | 9/1976 | Gruenwald | 2/49 |
| 3,995,321 | A | 12/1976 | Johnson | 2/49 |
| 4,023,570 | A | 5/1977 | Chinai et al. | 128/290 |
| 4,068,665 | A | 1/1978 | Nelson | 128/287 |
| 4,410,325 | A | 10/1983 | Lare | 604/389 |
| 4,523,334 | A | 6/1985 | Lavash | 2/49 |
| 4,660,226 | A | 4/1987 | Quilling et al. | 2/49 |
| 4,733,411 | A | 3/1988 | Foti | 2/49 |
| 4,743,242 | A | 5/1988 | Grube et al. | 604/389 |
| 4,808,252 | A | 2/1989 | Lash | 156/73.1 |
| 4,857,067 | A | 8/1989 | Wood et al. | 604/389 |
| 4,959,265 | A | 9/1990 | Wood et al. | 428/343 |
| 5,056,159 | A * | 10/1991 | Zemke, Jr. | 2/46 |
| 5,491,844 | A | 2/1996 | Kehl et al. | 2/49.1 |
| 5,809,568 | A * | 9/1998 | Morris-Jones | 2/49.1 |
| 5,881,382 | A | 3/1999 | Bernard et al. | 2/49.1 |
| 6,079,048 | A | 6/2000 | Campbell | 2/49.1 |
| 6,212,683 | B1 * | 4/2001 | Liebmann | 2/49.4 |
| 6,256,788 | B1 | 7/2001 | Loewer et al. | 2/49.2 |
| 6,261,278 | B1 | 7/2001 | Chen et al. | 604/389 |
| 6,413,603 | B1 | 7/2002 | Horton et al. | 428/40.1 |

* cited by examiner

*Primary Examiner*—Tejash Patel
(74) *Attorney, Agent, or Firm*—Perry Hoffman

(57) ABSTRACT

A disposable adhesive multi-use bib is disclosed configured for entertaining a child and wearable to protect the garments of the child or adult. The bib comprises a sheet component and a wearable component. At least the back surface of the wearable component is coated with an adhesive. The bib is designed to entertain a child while, for example, waiting to have food served or during a craft project. The wearable component is removed from the sheet component and is applied to the garments of the child for protecting the child's clothes while eating. The remaining sheet component is then utilized as a placemat.

22 Claims, 6 Drawing Sheets

DISPOSABLE ADHESIVE MULTI-USE BIB

CROSS REFERENCE TO RELATED APPLICATIONS

This application is entitled to the benefit of provisional patent application No. 60/414,731 entitled "Disposable Adhesive Multi-Use Bib" filed Sep. 30, 2002, and incorporated herein by reference.

FIELD OF THE INVENTION

The present invention relates to a disposable adhesive multi-use bib for protecting the garments of a wearer. More particularly, the bib is useful for entertaining a child or other interested party while waiting, for example, for their food to be served or during a craft project and then for protecting the garments of the child after the food has been served or during a craft project.

BACKGROUND OF THE INVENTION

As is known to those skilled in the art, young children often soil themselves, their clothing, and their immediate surroundings during a meal creating clothing stains that are not easily removed. Such problems have typically been mitigated by the use of bibs to cover the area of the torso underneath the mouth of the child. Bibs are well known in the art.

In the home, supervising adults often utilize multi-use fabric or plastic/vinyl bibs that collect misdirected or rejected foodstuffs during mealtime. The soiled bib can then be laundered and reused at the next meal. In a public setting, such as in restaurants, disposable bibs are provided for use by patrons during their visit.

Disposable bibs are well known in the art. Disposable bibs are designed to be worn once and discarded. Generally, a bib includes a functional portion for at least partially covering and protecting a wearer's garments and a fastening portion for fastening the bib to the wearer. Most typically, the fastening portion includes tie cords, hook and loop fasteners, buttons, leads with clips on each end, adhesive-backed straps or tabs, hook and eye or other adhesive configuration. Typical disposable bibs are made of a plastic or paper material and often include a depiction of a red lobster, animal or cartoon character imprinted thereon.

A number of adhesive disposable bibs are also known in the art. U.S. Pat. No. 3,979,776 to Gruenwald discloses a bib using adhesive straps to secure the bib to the wearer's shoulders. U.S. Pat. No. 3,995,321 to Johnson discloses a disposable bib having a food catching pocket held open by adhesive tabs secured to a supporting surface such as a table and an adhesive tab to secure the bib's neck closure. U.S. Pat. No. 5,491,844 to Kehl discloses a disposable bib for use by dental patients having a strip of pressure sensitive adhesive across the top edge of the back of the bib. U.S. Pat. No. 6,079,048 to Campbell discloses a self-adhesive napkin having adhesive material located along at least the top edge thereof. U.S. Pat. No. 6,256,788 to Loewer discloses a bib of absorbent material having a neck cut-out in the upper end and a pressure sensitive adhesive disposed over substantially the entire back surface of the bib except for an un-coated border surrounding the neck cut-out. In another embodiment of Loewer, the pressure sensitive adhesive is applied in strips running from top to bottom near the sides of the back side of the bib. U.S. Pat. No. 6,413,603 to Horton et al. discloses a placemat having intergrated adhesive stickers or labels used as decorations for the placemat.

SUMMARY OF THE INVENTION

According to the present invention there is provided a disposable adhesive bib that includes a sheet component with an upper edge, a lower edge and first and second edges and a wearable component that has a front and back surface. Substantially all of the back surface is coated with an adhesive. So that the wearable component may be releasably disposed within an area of the sheet component defined by the upper and lower edges and first and second edges of the sheet component. Upon use, the wearable component is removed from the sheet component and the sheet component may be retained for covering an eating surface.

According to another aspect of the invention, there is provided a disposable adhesive bib that includes a sheet component with an upper edge, a lower edge, first and second edges, and front and back surfaces. The back surface of the sheet component is coated with an adhesive and a liner is disposed over the adhesive. The disposable bib further includes a wearable component that is a sub-component of the sheet component and that has an upper edge, a lower edge, first and second edges, the wearable component is removable from the wearable component and the liner. The sheet component and wearable component are configured to cover at least a portion of an eating surface.

According to another aspect, there is provided a tablecloth with integrated disposable bibs. The tablecloth includes a table surface covering component and a wearable component that has an upper and lower edge, a first and second side, and a front back surface. The back surface includes an adhesive for releasably securing the wearable component to a wearer and for releasably securing the wearable component to the table surface covering component.

BRIEF DESCRIPTION OF THE DRAWINGS

FIG. 2*a* is a perspective view of a continuous roll of disposable bibs shown in FIG. 1.

DETAILED DESCRIPTION OF THE PREFERRED EMBODIMENTS

Figure 1:
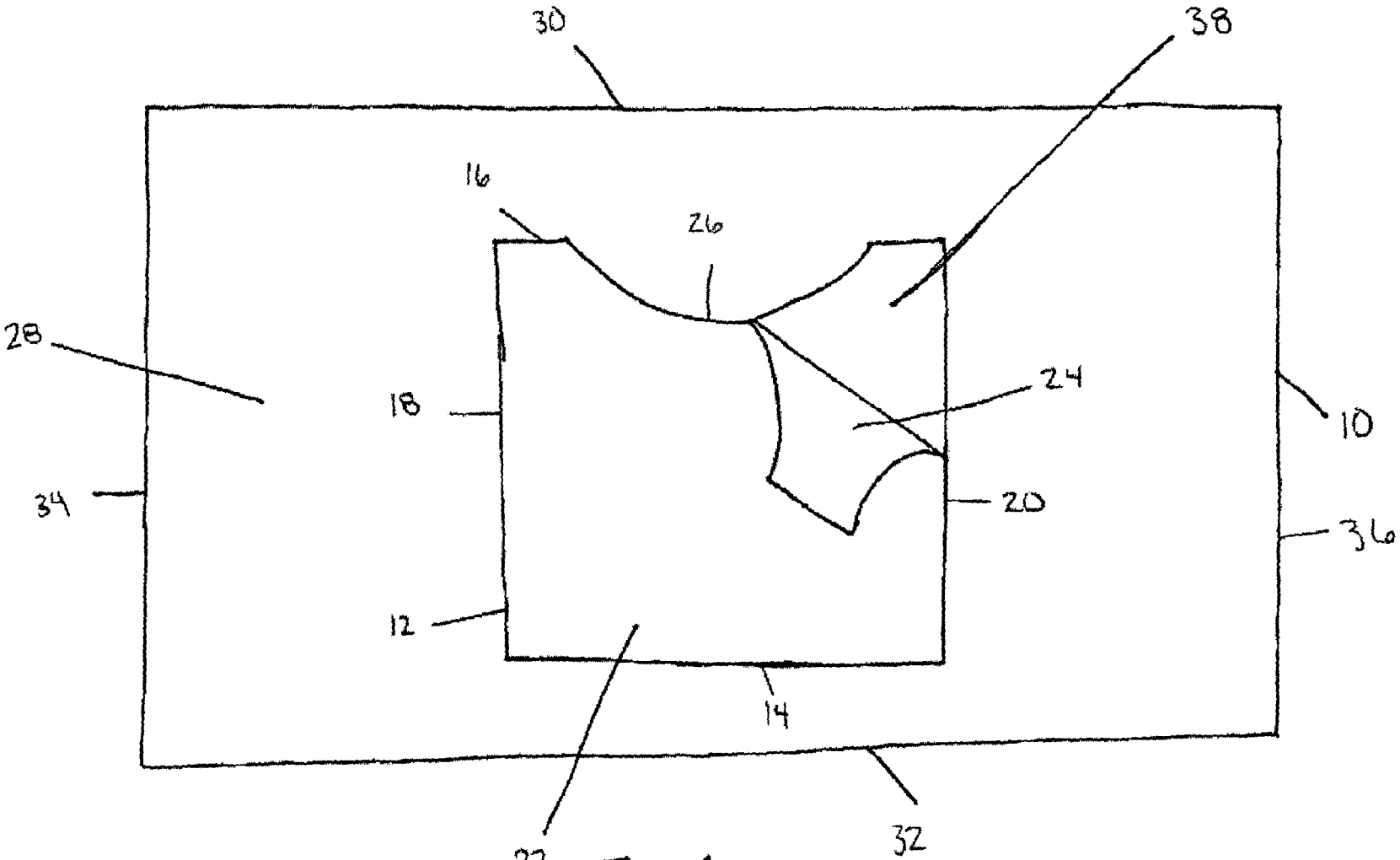
FIG. 1 is a top view of a disposable bib according to an embodiment of the invention.

FIG. 1 depicts one embodiment of a disposable bib of the present invention. Although discussed primarily with respect to children, it should be appreciated that the bib off of the subject invention is equally suitable for adult use. The bib includes a sheet component 10 and a wearable component 12, the wearable component 12 being a sub-component of the sheet component 10. In a preferred embodiment, the sheet component is a placemat. In FIG. 1, the sheet component 10 and the wearable component 12 are both generally rectangular. However, both components may be configured of any desired shape. Likewise, the shape of the sheet component 10 and wearable component 12 need not match. For example, the sheet component may be oval and the wearable component 12 configured as a rectangle within the oval. Additionally, the sheet 10 and wearable 12 components may be of any size depending on the use to which the bib is put and personal preferences.

The wearable component 12 includes a bottom edge 14, a top edge 16, first 18 and second side edges 20, and a front surface 22 and back surface 24. The top edge 16 preferably includes a cut out 26 approximately midway between the first side edge 18 and the second side edge 20 for accommodating the neck of a wearer. The cut out is depicted in the Figures (including FIG. 1) as a U-shape, however, the cut out may be configured in any shape, such as for example, a square or triangle. In addition, there may not be a cutout and the wearable component may be square or rectangular. The back surface 24 is substantially coated with an adhesive material for releasably adhering the wearable component 12 to the sheet component 10 and then to a wearer during use.

The sheet component 10 has a front surface 28 and a back surface, the back surface of the sheet component is not visible in the drawings but opposes the front surface 28. In one embodiment, the wearable component 12 is a subcomponent of the sheet component 10. Thus, the back surface of the sheet component 10 is substantially coated with an adhesive material. In this embodiment, a liner 38 overlies the adhesive to prevent adhesion to surfaces. The wearable component 12 is preferably die-cut within the sheet component 10 so that it may be removed from the sheet component 10 and the liner 38. For use, the wearable component 12 is peeled away from the liner 38, separating the wearable component 12 from the sheet component 10 and exposing the adhesive coated back surface 24. The adhesive coated back surface 24 of the wearable component 12 is pressed against a garment for protecting the portion of the garment covered by the wearable component 12 from soiling.

In an alternative embodiment, which would appear identical in 2-dimensions to the embodiment described in FIG. 1, the wearable component 12 is formed separately from the sheet component 10. That is, unlike the embodiment already described, the wearable component is not die-cut from the sheet component but rather is cut from a separate supply of material enabling the wearable component 12 and sheet component 10 to be formed of different material. For example, the sheet component could be formed of an inexpensive paper whilst the wearable component 12 could be formed of a more durable liquid impervious or absorbent material. In this embodiment, depending on the materials chosen for the sheet component 10, the sheet component 10 may include an area formed of a material to which the adhesive covered wearable component 12 can be releasably attached so that the wearable component 12 can be easily removed from the sheet component and adhered to a wearer. Thus, the wearable component 12 is the only component whose back surface is coated with an adhesive. Alternatively, the sheet component 10 could be formed of a material that is sufficiently slick to be used as a liner so that the wearable component 12 can be applied to a front surface of the sheet component without the need for the addition of a material from which the wearable component is readily released.

In any embodiment, the sheet component 10 and wearable component 12 may be constructed of any suitable material. For example, the wearable component may be constructed of a single layer of paper/vinyl, fabric, or plastic material. Alternatively, the wearable component may be composed of multiple layers with a moisture impervious backing to prevent liquid from contacting the garment and one or more layers of an absorbent material to prevent foodstuffs from dripping onto the garments of the wearer. Preferably, the material is sufficiently flexible to prevent crinkling or buckling when adhered to a garment.

The adhesive used to coat the back surface of the wearable component and/or sheet component preferably has a low tack characteristic so that it is readily releasable from the wearer following use of the wearable component without leaving adhesive residue, yet has sufficient adhesiveness to secure the wearable component during use. The adhesive may be pressure sensitive so that it secures the wearable component to the wearer once the wearable component is pressed against the garment.

In a preferred embodiment, the wearable component is made of a paper/vinyl mix with a pressure sensitive adhesive applied to the entire back surface of the wearable component. Thus, when the bib is placed on the child, the child can not readily lift the bib away from his or her clothing to soil the clothing.

Figure 2B:
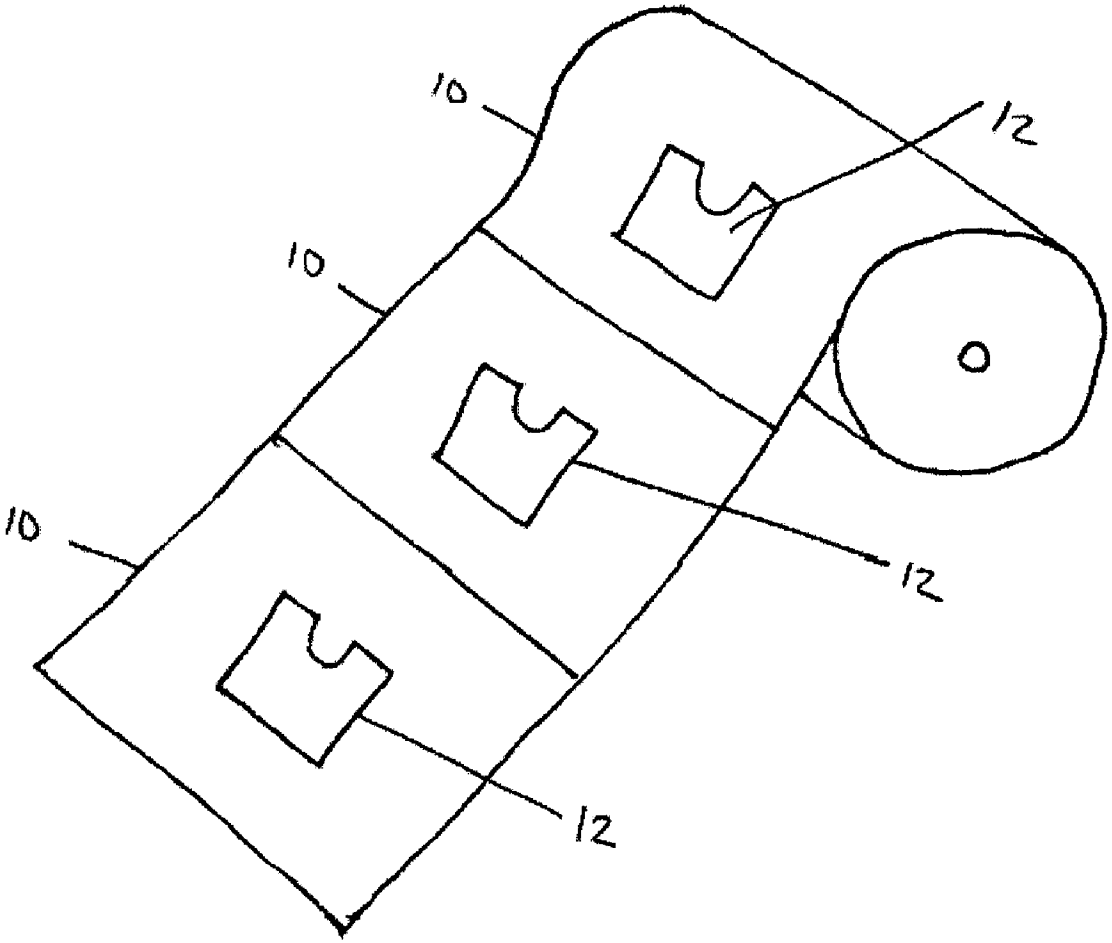
FIG. 2*b* is a perspective view of another embodiment of continuous roll of disposable bibs.
Figure 2C:
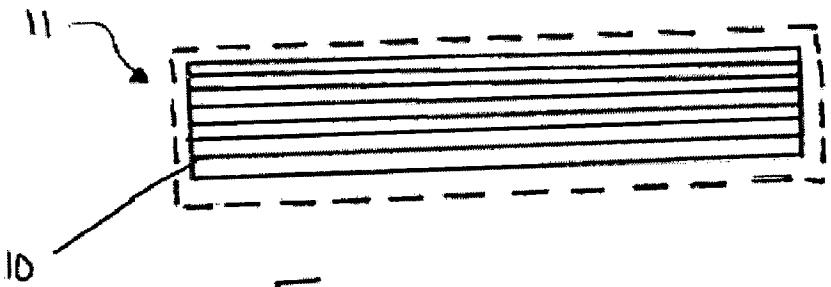
FIG. 2*c* is a side view of a package of a plurality of the disposable bibs shown in FIG. 1.
Figure 2B:
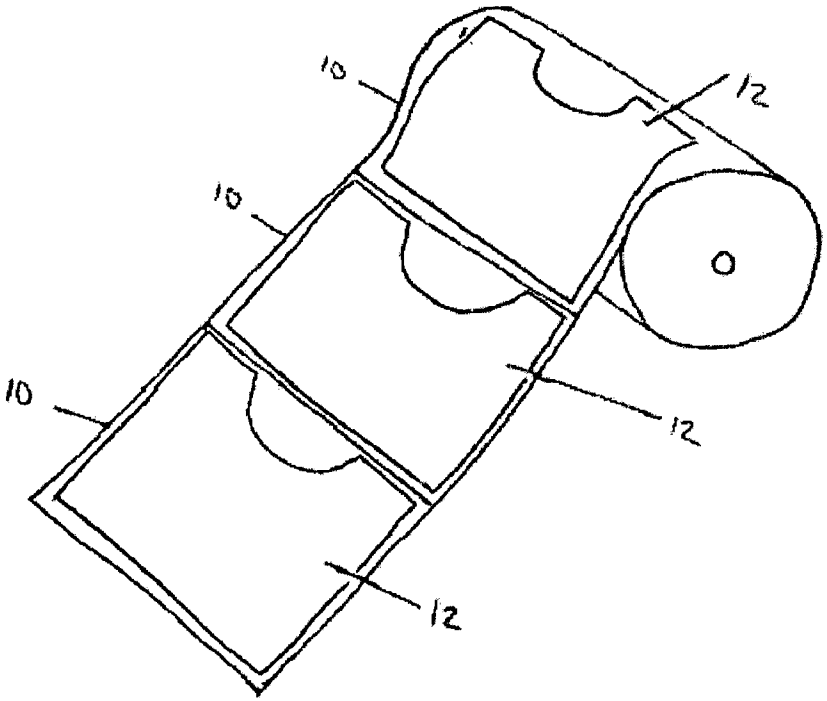

FIGS. 2*a*–2*c* illustrate methods of dispensing the disposable bib according to an embodiment of the invention. As is shown, in FIG. 2*a* a plurality of sheets components 10 with wearable components 12 may be detachably connected end-to-end, separated by perforations and provided on a roll, similar to a paper towel roll, so that individual bibs may be easily detached along the perforation. Alternatively, a continuous roll (without perforations) may be provided and individual bibs may be manually cut, peeled from the roll, or otherwise separated from the bib immediately adjacent. Similarly, in FIG. 2*b*, a continuous roll of disposable bibs is illustrated. In this embodiment, the sheet component 10 is minimized to conserve materials. Once the wearable component 12 is removed, the minimized sheet component 12 can be retained for use as a placemat.

FIG. 2*c* is a sideview of a plurality of disposable bibs stacked one on top of each other. The edge of each sheet component 10 is visible in this view. The stack 11 may be secured as with shrink wrapping (shown in phantom in the Figure) or bundled with string or ribbon or the stack of bibs may be individually held in a container. Alternately, a strip of adhesive can be applied along an edge of the stack 11 so that each bib is removably secured to one another. Upon use, an individual bib is torn off the stack.

The sheet component may be sized and shaped in a variety of configurations. For example, in one embodiment, as depicted in FIG. 1, the sheet component is sized and shaped to be suitable for use as a placemat to overlay a table or other surface, such as a tray, in the wearer's eating area. Although in FIG. 1 the sheet component 10 is shown as a rectangle, it should be appreciated that the sheet component 10 can be provided in other shapes.

Figure 3:
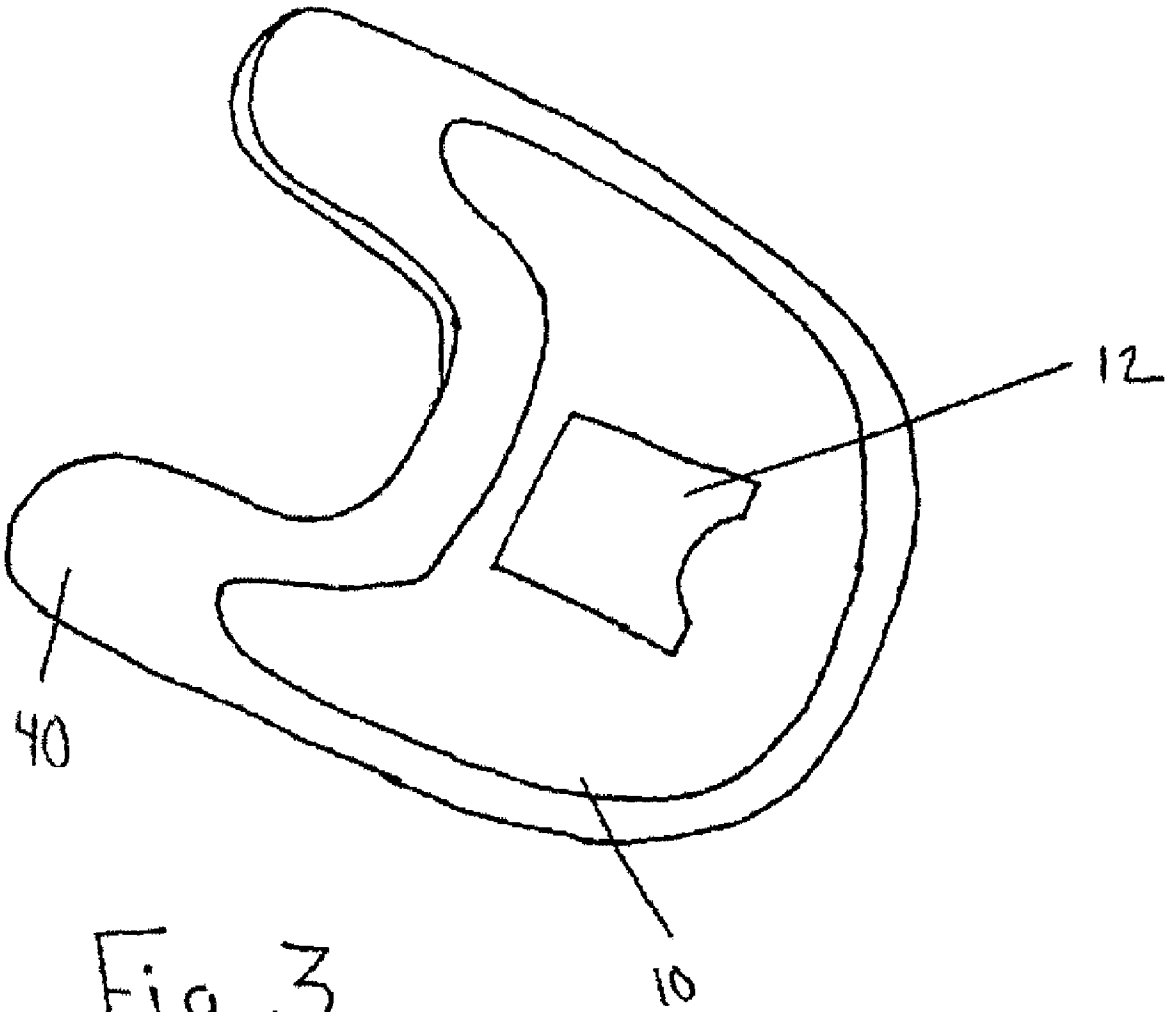
FIG. 3 is a top view of a disposable bib according to an embodiment of the invention.

Alternatively, as shown in FIG. 3, the sheet component 10 may be sized and shaped to fit in the tray portion 40 of a high chair (not shown). In this embodiment, the sheet component 10 may be sized and shaped to follow the contours of the high chair tray 40 or may be formed of any shape in a size that fits within the boundaries of the tray.

Figure 4:
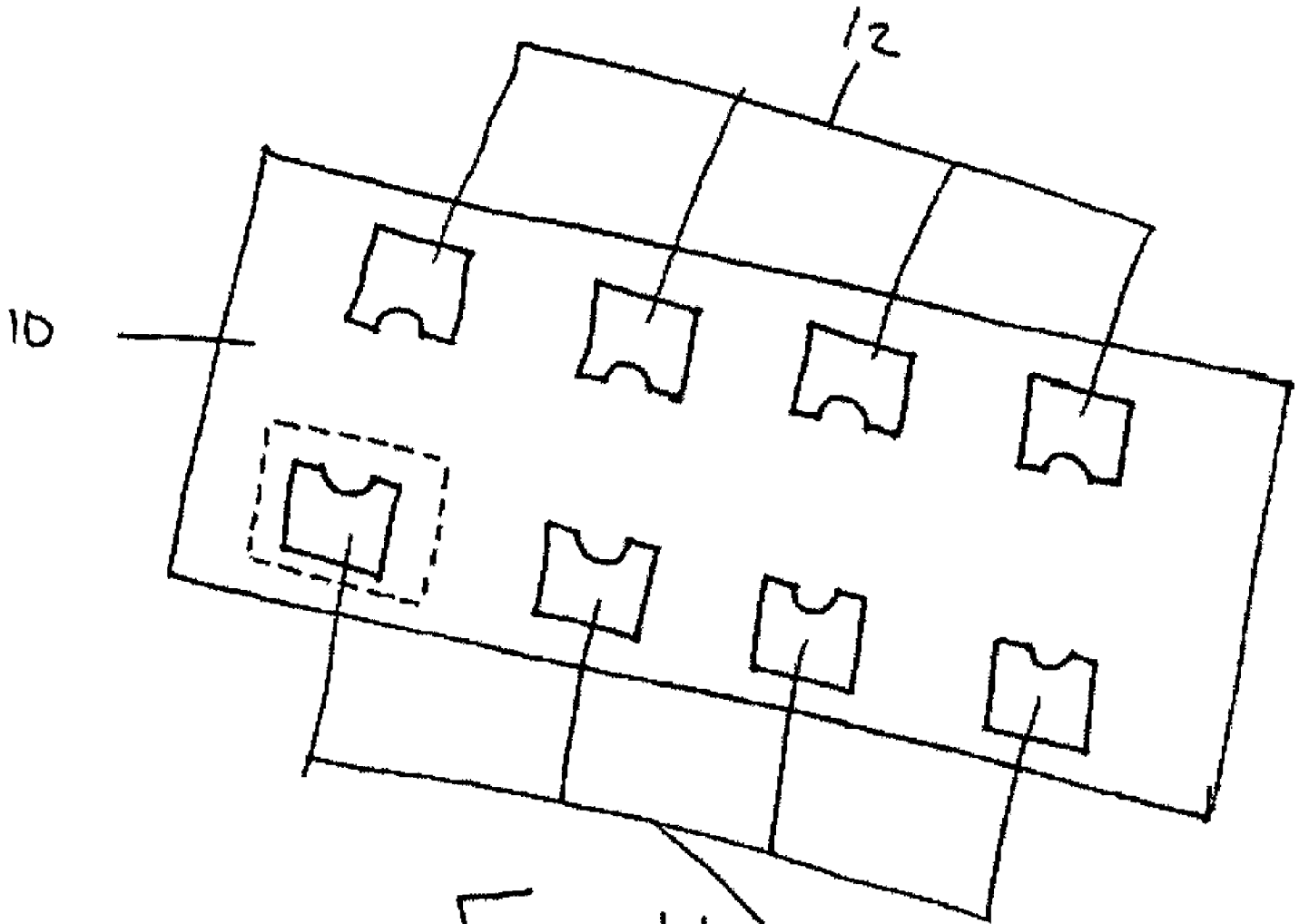
FIG. 4 is a top view of tablecloth provided with a plurality of disposable bibs according to an embodiment of the invention.

FIG. 4 illustrates yet another embodiment wherein a plurality of disposable bibs 12 are provided on the sheet component 10 that may be sized and configured to function as a tablecloth. The plurality of bibs 12 may be spaced apart from one another to function as place settings (shown in phantom in the drawing). The sheet 10 may be formed of plastic, fabric, paper or any other material and may further include sections of a sufficiently slick material to which the bibs may be releasably attached so that the bibs may be easily removed from the tablecloth for use. The tablecloth could be used at birthday parties or other occasion and decorated with birthday themes or other appropriate themes. The tablecloth sheets may be provided pre-cut to accommodate a variety of the table shapes and sizes. Alternatively, the sheet may be provided on a continuous roll and cut-to-order for custom sizing to accommodate any specific need.

Figure 5A:
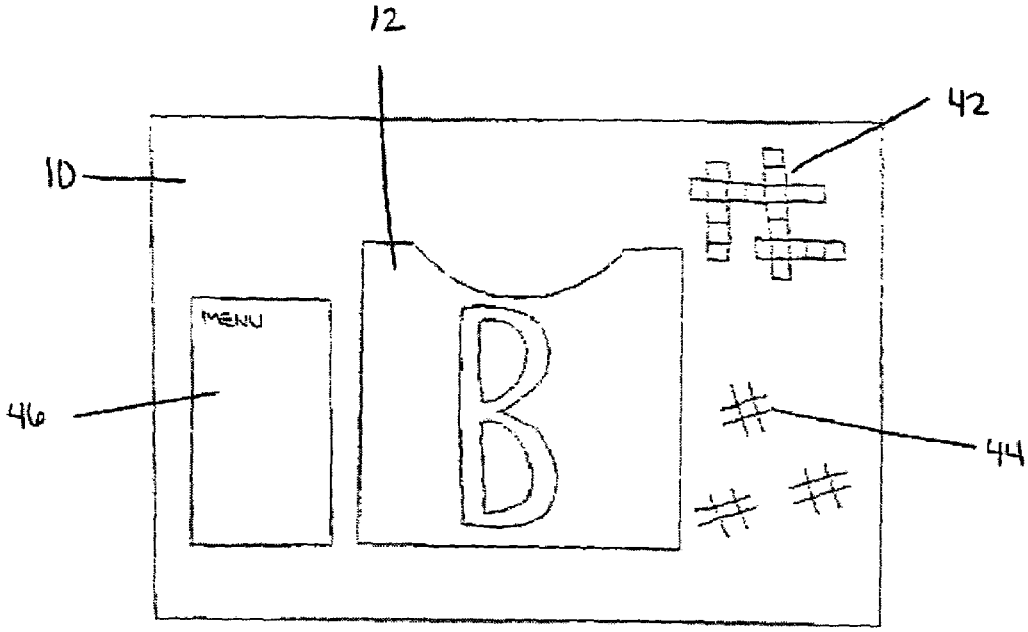
FIG. 5*a* is a top view of a placemat incorporating a disposable bib with the bib adhered to the placemat according to an embodiment of the invention.
Figure 5B:
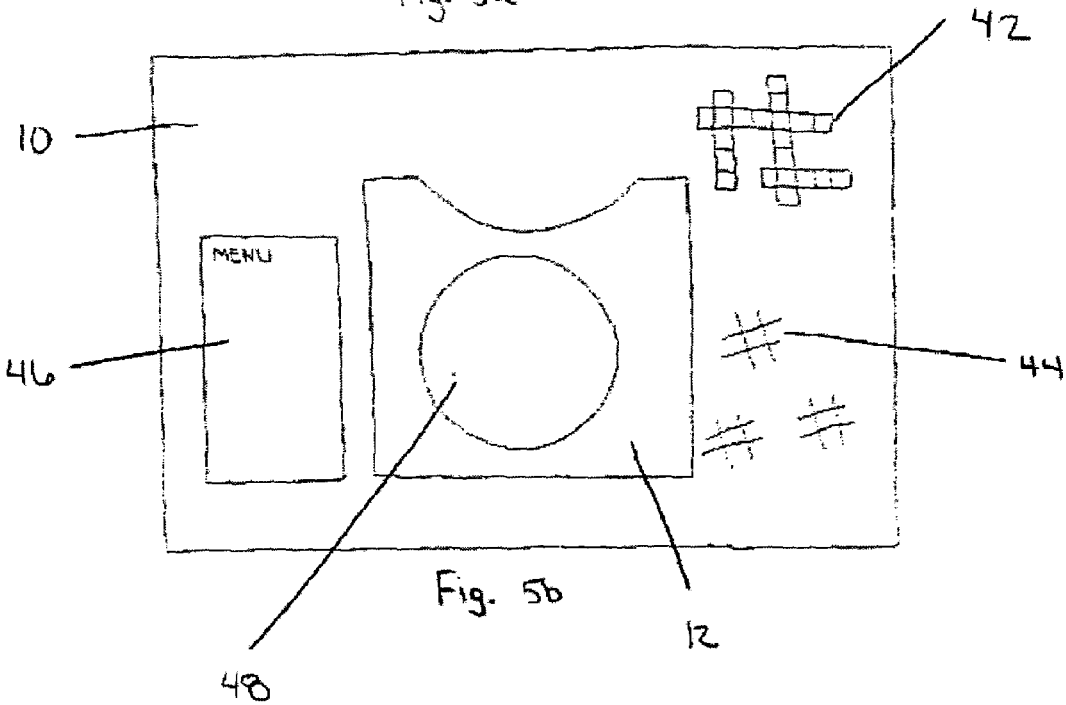
FIG. 5*b* is a top view of the placemat shown in FIG. 5*a* with the bib removed from the placemat.

For any of the embodiments already described, the sheet component and/or wearable component can advantageously be designed so as to be suitable for providing entertainment to a child. For example, the tablecloth, placemat, and/or bib may be self-decorated by the child or other interested party. An example of several of the many decorative and entertaining possibilities are shown in FIGS. 5*a* and 5*b*. The sheet component 10 and the wearable component 12 may be designed for coloring on by a child and/or include games such as crossword puzzles 42, connect-the dot puzzles, tic-tac-toe boards 44, and riddles, for example. Alternately, the sheet component and wearable component may incorporate a super hero theme with the bib, for example, being a part of a superhero costume. The sheet component may also incorporate, for example, a kid's menu 46 for a restaurant or advertisement with the company logo.

The sheet component 10 may be decorated with themes such as dinosaurs, animals, or cartoons or other objects attractive to children. Additionally, the sheet may include shapes in which the children can fill in with color or open spaces for free-hand art. In one embodiment, the wearable components cover up numbers, letters, or other indicia that can be used to indicate the winner of a lottery for a prize, so that the child that uncovers the pre-selected number, letter or other indicia collects a prize. Alternatively, any specific number, letter, or other indicia may correlate to a specific prize so that each child is the recipient of a reward.

In another embodiment the surface of the bib includes a riddle, puzzle, or spelling or math problem and the answer is printed underneath the bib so that the child can check his or her answer by removing the bib. As an example only, FIGS. 5*a* and 5*b* and illustrate one possible spelling lesson. FIG. 5*a* illustrates a disposable bib with the wearable component 12 still adhered to the sheet component 10. The wearable component 12 includes the letter "B" printed thereon. FIG. 5*b* illustrates the same disposable bib with the wearable component 12 removed. As can be seen, a depiction of a ball 48, a word that begins with the letter "B", is revealed to assist the child in learning the alphabet. This spelling riddle can be repeated with any letter of the alphabet and any corresponding depiction of any object whose name begins with the letter printed on the wearable component.

In addition, the sheet component may include removable stickers that the child can use to decorate the sheet component, wearable component or both. In one example, the wearable component may be decorated with a landscape such as a prehistoric desert. Stickers of various dinosaurs that existed in such an environment may be provided on the sheet component. The child can populate the landscape shown on the wearable component with the dinosaur stickers.

The possibilities for decorating the sheet and wearable components are innumerous and should not be limited to the examples described herein.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A disposable adhesive bib comprising:

a sheet component having an upper edge, a lower edge and first and second edges; and a wearable component having a front and back surface, with substantially all of the back surface being coated with an adhesive, the wearable component being releasably disposed within an area of the sheet component defined by the upper and lower edges and first and second edges of the sheet component;

wherein the wearable component is removed from the sheet component and the sheet component is retained for covering an eating surface.

2. The disposable bib of claim 1, wherein the wearable component includes an upper edge, a lower edge, first and second side edges and a neck cut-out along the upper edge generally midway between the first and second edges.

3. The disposable bib of claim 1, wherein the wearable component is a separate component from the sheet component.

4. The disposable bib of claim 1, wherein the sheet component is sized and configured to function as a placemat.

5. The disposable bib of claim 1, wherein the sheet component is sized and configured to function as a tablecloth.

6. The disposable bib of claim 1, wherein the sheet component is sized and configured to line and cover at least a portion of high chair tray.

7. The disposable bib of claim 1, wherein the sheet component is formed of paper.

8. A tablecloth with integrated disposable bibs comprising:

a table surface covering component; and a wearable component having an upper and lower edge, a first and second side, and a front back surface, wherein the back surface includes an adhesive for releasably securing the wearable component to a wearer, the wearable component being releasably secured to the table surface covering component wherein the wearable component is separated from the table surface covering component, allowing the table surface covering component to be removed from the wearable component and retained for covering an eating surface.

9. The tablecloth of claim 8, wherein the table surface covering component includes a second surface for releasably securing the wearable component to the table surface covering component so that the wearable component may be easily removed and secured to a wearer.

10. The tablecloth of claim 8, wherein the wearable component includes a neck-sized cut-out in the upper edge of the wearable component, positioned approximately midway between the first and second edges and extending toward the lower edge.

11. The tablecloth of claim 8, wherein the table surface covering component is configured for entertaining children.

12. The tablecloth of claim 8, wherein the table surface covering component is pre-cut to a specific dimension.

13. The tablecloth of claim 8, wherein the table surface covering component includes decorative adhesive stickers for decorating the wearing component and table surface covering component.

14. A disposable adhesive bib comprising:

a wearable component having a front and back surface with substantially all of the back surface being coated with an adhesive; and an eating surface covering sheet component having an upper edge, a lower edge and first and second edges, the wearable component being releasably disposed within an area of said sheet component defined by the upper and lower edges and first and second edges of said sheet component allowing removal therefrom for separating the wearable component from said sheet component, said sheet component separated from the wearable component being retained for covering an eating surface.

15. The disposable bib of claim 14, comprising:

a liner disposed over the adhesive; and the wearable component having an upper edge, a lower edge, first and second edges of the wearable component and being a sub-component of the sheet component, said sheet component and said liner together being separable from the wearable component with said sheet component and said liner together being retained for covering the eating surface.

16. The disposable bib of claim 15, wherein the wearable component includes a neck-sized cut-out in the upper edge of the wearable component, positioned approximately midway between the first and second edges and extending toward the lower edge.

17. The disposable bib of claim 15, wherein the sheet component and liner are configured for entertaining a child.

18. The disposable bib of claim 14, wherein the sheet component and the wearable component is formed of a paper/vinyl blend.

19. The disposable bib of claim 14, wherein the eating surface is a high chair tray.

20. The disposable bib of claim 14, wherein the sheet component is configured to function as a placemat.

21. The disposable bib of claim 14, wherein a plurality of the disposable bibs are stacked and packaged together with shrink wrap.

22. The disposable bib of claim 14, wherein a plurality of disposable bibs are attached along the upper or lower edge of the sheet component with adhesive.

* * * * *